US005749515A

United States Patent [19]

Duprez

[11] Patent Number: 5,749,515

[45] Date of Patent: May 12, 1998

[54] VALVE VENTING APPARATUS

[75] Inventor: Wayne R. Duprez, Waltham, Mass.

[73] Assignee: Standard-Thomson Corporation, Waltham, Mass.

[21] Appl. No.: 799,113

[22] Filed: Feb. 11, 1997

[51] Int. Cl.[6] ..... F01P 7/16

[52] U.S. Cl. ..... 236/34.5; 251/358

[58] Field of Search ..... 236/34, 34.5; 251/358; 137/375

[56] References Cited

U.S. PATENT DOCUMENTS

| | | | |
|---|---|---|---|
| 2,829,835 | 4/1958 | Branson | 236/34.5 |
| 3,456,682 | 7/1969 | Blackford | 251/358 |
| 4,300,718 | 11/1981 | Beyer | 236/34.5 |
| 4,347,973 | 9/1982 | Jackson | 236/34.5 |
| 4,358,051 | 11/1982 | Hunt | 236/34.5 |
| 4,475,711 | 10/1984 | Rountry | 251/358 |
| 4,643,134 | 2/1987 | Schnizlein | 123/41.1 |
| 4,679,530 | 7/1987 | Kuze | 123/41.1 |
| 4,745,885 | 5/1988 | Koinuma | 123/41.05 |
| 4,872,476 | 10/1989 | Pflum | 137/513.5 |
| 4,898,204 | 2/1990 | Wallace | 251/358 |
| 4,978,060 | 12/1990 | Stahly | 236/34.5 |
| 5,294,046 | 3/1994 | Fishman | 236/34.5 |
| 5,381,953 | 1/1995 | Fishman | 236/34.5 |
| 5,413,096 | 5/1995 | Hart | 251/358 |

*Primary Examiner*—William E. Tapolcai
*Attorney, Agent, or Firm*—Barnes & Thornburg

[57] ABSTRACT

A thermostat includes a valve movable from a closed position to an open position to permit fluid flow through a conduit in an engine. The valve is formed to include a vent opening defined by a wall. The thermostat also includes an actuator for selectively opening and closing the valve, an elastomeric material located on the valve covering the wall defining the vent opening, and a jiggle pin located in the vent opening.

12 Claims, 3 Drawing Sheets

VALVE VENTING APPARATUS

BACKGROUND AND SUMMARY OF THE INVENTION

The present invention relates to a thermostat and particularly to a thermostat which operates as a coolant fluid flow control valve in a fluid flow system of an engine. More particularly, the present invention relates to a thermostat having a valve venting apparatus for allowing air to vent out of the fluid flow system when fluid is added to the fluid flow system.

It is well known to provide a thermostat in a fluid flow system for controlling the volume of fluid flow through a heat-exchanger or radiator of the fluid flow system to maintain the fluid at a desired temperature. Conventional thermostats operate as a valve having a movable valve member that opens away from and closes against a valve seat formed in a stationary valve member in response to the temperature of the fluid surrounding the thermostat. See, for example, U.S. Pat. No. 5,381,952 to Duprez, which is assigned to the assignee of the present invention; U.S. Pat. No. 4,745,885 to Koinuma; and U.S. Pat. No. 4,679,530 to Kuze; each of which discloses a thermostat used in the fluid flow system of an internal combustion engine.

It is also well known to provide a small vent opening in the thermostat to allow air to vent out of the fluid flow system when the fluid flow system is filled with fluid. In other words, the vent opening allows air that would be trapped in the engine by the closed thermostat valve to vent out to the radiator and be replaced by coolant as the engine fills through a bottom radiator hose. Failure to vent this entrapped air would result in an improper fill of the system, with the radiator filling with fluid and the engine full of air only. After filling, the vent opening in the thermostatic valve continues to allow a small flow of coolant to the radiator.

In a further development of the valve venting concept, a separate valve is added for the vent opening to prevent constant leakage of fluid to the radiator when the engine is running. There are two basic approaches for this vent valve currently employed in the automotive industry. A first approach is to use a ball enclosed by a housing. However, this vent housing can clog up and quit working. In addition, the durability of the metal ball and valve seat can pose problems. Plastic, rubber or resilient balls have not been a successful solution due to their light weight and inability to meet venting levels required.

A second approach for providing a valve for the vent opening is to use a "jiggle pin" mounted in the vent opening. The jiggle pin operates as a check valve which opens when fluid is added to the system to allow air to escape from the fluid flow system and which closes during normal operation of the fluid flow system due to pressurization of the fluid flow system when the thermostat is closed. This provides an anti-clogging feature due to the self-cleaning effect of the jiggle pin motion, or "jiggle", caused by the fluid turbulence when the thermostat opens. See, for example, U.S. Pat. Nos. 5,381,953 to Fishman; 4,745,885 to Koinuma; 4,679,530 to Kuze; and 2,829,835 to Branson. Each of these references discloses a jiggle pin received by a vent opening formed in a flange of a thermostat.

The stationary valve member, movable valve member, and jiggle pin of conventional thermostats are typically made out of a metal material. Over a period of time, the jiggle pin and the thermostat component to which the jiggle pin is mounted suffer structural degradation due to wear caused by metal-on-metal contact of the jiggle pin with the thermostat component to which the jiggle pin is mounted. As a result of the metal-on-metal wear, the ability of the jiggle pin to close off the vent opening during normal operation of the fluid flow system is diminished resulting in leakage of fluid though the thermostat when the movable valve member is closed against the stationary valve member.

The present invention provides a valve venting apparatus having a wear-resistant, elastomeric material applied to the thermostat component to which the jiggle pin is mounted. The elastomeric material is applied to the thermostat component around an edge wall defining the vent opening and to surfaces of the thermostat component adjacent to the vent opening. The elastomeric material prevents metal-on-metal contact between the jiggle pin and the thermostat components to which the elastomeric material is applied, thus reducing wear of the jiggle pin and the thermostat component.

The elastomeric material of the present invention also provides for an improved seal between the jiggle pin and the thermostat component in which the jiggle pin is mounted. As a result, the jiggle pin closes the vent opening to prevent leakage of fluid through the thermostat during normal operation when the thermostat is closed. The elastomeric material is selected so that the valve venting apparatus maintains its leakage integrity for the service life of the thermostat.

According to one aspect of the present invention, a thermostat is provided for controlling coolant fluid flow through a conduit in an engine. The thermostat includes a valve movable from a closed position to an open position to permit fluid flow through the conduit. The valve is formed to include a vent opening defined by a wall. The thermostat also includes an actuator for selectively opening and closing the valve, an elastomeric material located on the valve covering the wall defining the vent opening, and a jiggle pin located in the vent opening.

The thermostat includes a stationary valve member and a movable valve member. In one illustrated embodiment, the vent opening is formed in the stationary valve member. In another illustrated embodiment, the vent opening is formed in the movable valve member.

According to another aspect of the present invention, a thermostat is provided for controlling coolant fluid flow in an engine. The thermostat includes a stationary valve member formed to include an annular valve seat configured to define an opening. The thermostat also includes a movable valve member coupled to the stationary valve member for movement into and out of engagement with the annular valve seat. The movable valve member is formed to include a vent opening defined by an edge wall. The thermostat further includes a spring for biasing the valve member to a normally closed position against the annular valve seat of the stationary valve member, an actuator for selectively moving the movable valve member to an opened position away from the annular valve seat, and a jiggle pin having a neck portion located in the vent opening of the movable valve member, a head portion, and an anchor portion. The jiggle pin is movable within the vent open so that the anchor portion opens and closes the vent opening. The thermostat still further includes an elastomeric material located on the movable valve member covering the edge wall to reduce wear on the jiggle pin.

In the illustrated embodiment, the movable valve member includes a top surface and a bottom surface. The elastomeric material covers at least a portion of the top and bottom surfaces adjacent to the vent opening to reduce wear on the head and anchor portions of the jiggle pin. The movable valve member also includes an outer edge and the elastomeric material covers outer edge so that the elastomeric material contacts the valve seat when the movable valve member is in the closed position.

According to yet another aspect of the present invention, a thermostat is provided for controlling coolant fluid flow in an engine. The thermostat includes a stationary valve member having an annular flange for mounting the thermostat apparatus. The stationary valve member is formed to include an annular valve seat configured to define an opening. The annular flange is also formed to include a vent opening defined by an edge wall. The thermostat also includes a movable valve member coupled to the stationary valve member for movement into and out of engagement with the annular valve seat, a spring to bias the movable valve member to a normally closed position against the annular valve seat of the stationary valve member, and an actuator coupled to the movable valve member to move the movable valve member selectively to an opened position spaced apart from the annular valve seat. The thermostat further includes a jiggle pin located in the vent opening of the stationary valve member, and an elastomeric material located on the stationary valve member and covering the edge wall of the vent opening to reduce wear of the jiggle pin.

In the illustrated thermostat, the annular flange includes a top surface and a bottom surface. The jiggle pin includes a neck portion, an anchor portion and a head portion to hold the jiggle pin within the vent opening. The elastomeric material is located on the top and bottom surfaces of the annular flange adjacent to the vent opening to reduce wear of the head and anchor portions of the jiggle pin. The annular flange includes an outer edge, and the elastomeric material covers the outer edge of the annular flange.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
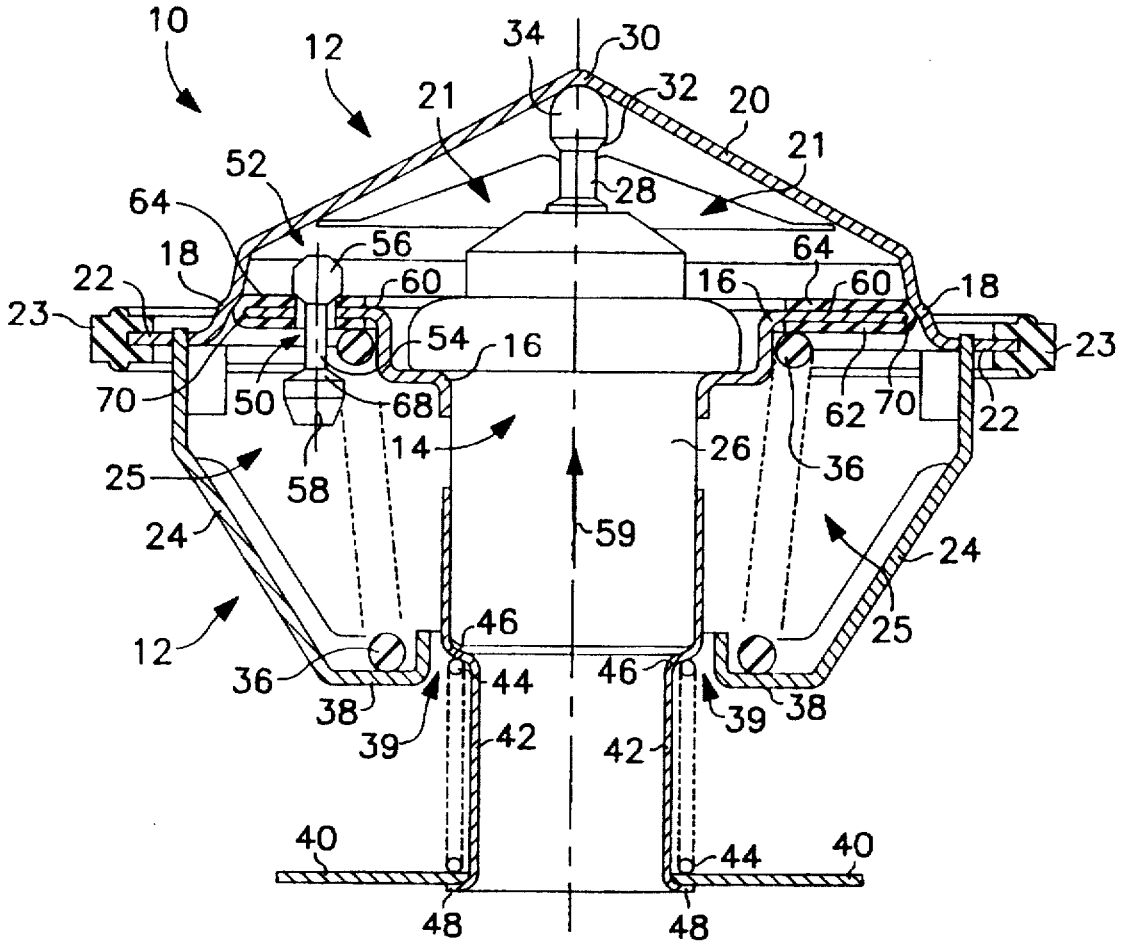
FIG. 1 is a cross-sectional view of a thermostat in accordance with the present invention showing a movable valve member formed to include a vent opening, a jiggle pin located in the vent opening, and a wear-resistant, elastomeric material applied to the movable valve member to reduce wear on the jiggle pin.

A thermostat 10 in accordance with the present invention includes a stationary valve member 12, a thermally responsive actuator 14, and a movable valve member 16 mounted on thermally responsive actuator 14, as shown in FIG. 1. Stationary valve member 12 is formed to include an annular valve seat 18. Actuator 14 moves movable valve member 16 into and out of engagement with valve seat 18 in response to an ambient temperature of fluid (not shown) which surrounds thermostat 10. In another embodiment, the actuator may be electrically controlled.

Stationary valve member 12 includes an upper bridge 20 positioned to lie above annular valve seat 18, an annular mounting flange 22 extending radially outwardly from the valve seat 18, and a lower bridge 24 mounted to flange 22 and positioned to lie below upper bridge 20, as shown in FIG. 1. When thermostat 10 is installed in a fluid flow system (not shown), mounting flange 22 is sandwiched between an inlet conduit member and an outlet conduit member each of which include one or more fluid flow passageways.

The inlet conduit is adjacent to lower bridge 24 and engages a bottom portion of mounting flange 22 and the outlet conduit is adjacent to upper bridge 20 and engages a top portion of mounting flange 22. The thermostat 10 also includes an annular gasket 23 mounted to annular flange 22 to provide a seal between the inlet and outlet conduit members.

Lower bridge 24 is formed to include openings 25 which allow the fluid to flow from the inlet conduit into contact with both thermally responsive actuator 14 and movable valve member 16. Similarly, upper bridge 20 is formed to include at least one opening 21 which allows the fluid to flow from thermostat 10 into the outlet conduit when movable valve member 16 is moved out of engagement with valve seat 18 by actuator 14. Thus, annular valve seat 18 is formed to define an opening and actuator 14 moves movable valve member 16 to open and close the opening to control the flow of fluid through thermostat 10.

Actuator 14 includes a cylindrical housing 26, to which the movable valve member 16 is mounted, and an elongated stem 28 extending upwardly out of housing 26 and engaging an apex 30 of upper bridge 20 in a conventional manner. Upper bridge 20 includes a stem lock tab 32 which is formed around a stem bulb 34 of stem 28 to prevent stem 28 from separating away from upper bridge 20.

An operating spring 36 is coiled around housing 26 and is compressed between a bottom wall 38 of lower bridge 24 and movable valve member 16, as shown in FIG. 1. Spring 36 biases movable valve member 16 upwardly into a normally closed position in contact with annular valve seat 18. Because valve member 16 is mounted to housing 26, spring 36 also biases housing 26 upwardly around stem 28 toward upper bridge 20. Bottom wall 38 of lower bridge 24 is formed to include an opening 39 and a portion of housing 26 is received in opening 39 when valve member 16 is in the closed position, as shown in FIG. 1.

Thermally responsive actuator 14 includes a thermally responsive material inside housing 26. As the temperature of the fluid surrounding thermostat 10 increases, the thermally responsive material expands. When the fluid reaches a predetermined temperature, the expansion of the thermally responsive material extends stem 28 out of housing 26, but since stem 28 is fixed to upper bridge 20 of stationary valve member 12, housing 26 will move downwardly away from upper bridge 20 through opening 39 of bottom wall 38 overcoming the biasing force of spring 36 and pulling movable valve member 16 out of contact with annular valve seat 18. Separation of valve member 16 from valve seat 18 allows the fluid to flow between valve member 16 and valve seat 18 from the inlet conduit side of thermostat 10 into the outlet conduit side of thermostat 10 to a radiator.

The illustrated thermostat 10 additionally includes a bypass valve 40 which is mounted on a cylindrical member 42. Cylindrical member 42 is mounted to cylindrical housing 26 of actuator 14 and extends downwardly therefrom, as shown in FIG. 1. A biasing spring 44 is compressed between a shoulder 46 of cylindrical member 42 and bypass valve 40. Biasing spring 44 biases bypass valve 40 downwardly into contact with a lower lip 48 of cylindrical member 42.

Figure 2:
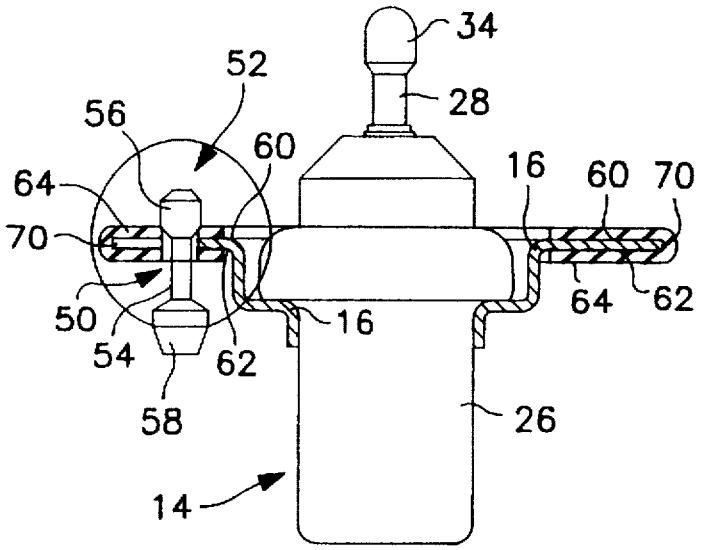
FIG. 2 illustrates the movable valve member mounted on a thermally responsive actuator, the jiggle pin having a head portion positioned above the movable valve member, the jiggle pin having a neck portion extending downwardly from the head portion through the vent opening, and an anchor portion attached to the neck portion below the movable valve member.
Figure 3:
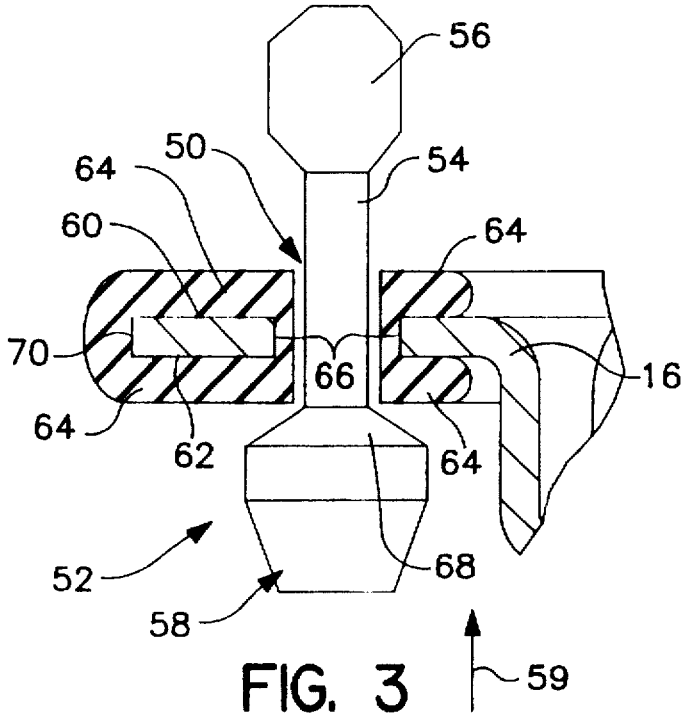
FIG. 3 is an enlarged cross-sectional view of a portion of the thermostat of FIG. 2 illustrating the wear-resistant, elastomeric material applied to top and bottom surfaces of the movable valve member and to an edge wall which defines the vent opening.

Movable valve member 16 of thermostat 10 is formed to include a vent opening 50 and a jiggle pin 52 is located in the vent opening 50 as shown in FIGS. 1–3. Jiggle pin 52 includes a neck portion 54 which has a smaller diameter than vent opening 50, a head portion 56 which has a transverse dimension that is larger than the diameter of vent opening 52, and an anchor portion 58 which has a larger diameter than vent opening 52. Neck portion 54 extends through vent opening 50. Head portion 56 is positioned to lie above an upper surface 60 of movable valve member 16, and anchor portion 58 is positioned to lie below a bottom surface 62 of movable valve member 16, as shown in FIGS. 1–3. Thus, head portion 56 and anchor portion 58 cooperate with neck portion 54 to hold the jiggle pin 52 in the vent opening 50.

Before jiggle pin 52 is mounted on movable valve member 16, head portion 56 has a smaller diameter than vent opening 50 so that jiggle pin 52 can be inserted through vent opening 50. After jiggle pin 52 is inserted through vent opening 50, head portion 56 is flattened into the shape shown generally in FIGS. 1–3 so that jiggle pin 52 is held within the vent opening 50.

Anchor portion 58 is movable to open and close vent opening 50 so that jiggle pin 52 operates as a check valve for relieving pressure across movable valve member 16. When the valve 12 is subjected to pressure in the direction of arrow 59, anchor portion 58 moves into engagement with the movable valve member 16 as shown in FIG. 3. When pressure in the direction of arrow 59 is reduced, gravity causes jiggle pin 52 to move to the position of FIGS. 1–3. Head portion 56 only partially covers vent opening 50 to allow venting through vent opening 50. For example, when fluid is added to the fluid flow system, the added fluid displaces air which is trapped in the fluid flow system and the displaced air pressurizes the inlet conduit. The head portion 56 allows the air to escape from the inlet conduit into the outlet conduit and ultimately out of the fluid flow system. The thermostat 10 of the present invention can be used in either direction at the inlet or outlet of the engine cooling system.

Movable valve member 16 of the illustrated thermostat 10 is coated with a wear-resistant elastomeric material 64, as shown in FIGS. 1–3. Elastomeric material 64 is applied to top surface 60 of movable valve member 16 so that head portion 56 of jiggle pin 52 is prevented from contacting top surface 60 of movable valve member 16. Similarly, elastomeric material 64 is applied to bottom surface 62 of movable valve member 16 so that anchor portion 58 of jiggle pin 52 is prevented from contacting bottom surface 62 of movable valve member 16. In addition, elastomeric material 64 is applied to an edge wall 66 which defines the vent opening 50 so that neck portion 54 of jiggle pin 52 is prevented from contacting the metal of edge wall 66, as shown best in FIG. 3.

Jiggle pin 52 and movable valve member 16 of the illustrated thermostat 10 are made from a metal material. Therefore, elastomeric material 64 prevents metal-on-metal contact between jiggle pin 52 and movable valve member 16. Thus, elastomeric material 64 reduces wear and structural degradation of jiggle pin 52 and movable valve member 16 during the service life of thermostat 10. Preferably, elastomeric material 64 is made from an appropriate NBR or EPDM material.

Elastomeric material 64 also advantageously improves the ability of anchor portion 58 to close vent opening 50 so that fluid leakage through vent opening 50 is minimized or eliminated. Anchor portion 58 is formed to include a tapered surface 68 that engages a portion of elastomeric material 64 adjacent to vent opening 50. Engagement of tapered surface 68 with elastomeric material 64 resiliently deflects the portion of wear-resistant coating 64 adjacent to vent opening 50 to seal vent opening 50 as shown best in FIG. 3.

Elastomeric material 64 is also applied to an outer parametrial edge 70 of movable valve member 16, as shown in FIGS. 1–3. Thus, elastomeric material 64 is contiguously applied to top surface 60, bottom surface 62, parametrial edge 70, and edge wall 66 defining vent opening 50. A portion of elastomeric material 64 adjacent to parametrial edge 70 engages annular valve seat 18 when movable valve member 16 is in the closed position, as shown in FIG. 1. Engagement of elastomeric material 64 with valve seat 18 improves the seal between movable valve member 16 and valve seat 18, as shown in FIG. 1.

Although the illustrated thermostat 10 includes bypass valve 40, it is understood that the elastomeric material 64 to be used to prevent metal-on-metal wear between a jiggle pin 52 and the thermostat can be used on any type of thermostat. In addition, it is within the scope of the invention as presently perceived for the elastomeric material 64 to be applied only on areas of the thermostat near vent opening 50 and for vent opening 50 to be formed in a thermostat component other than movable valve member 16.

Figure 4:
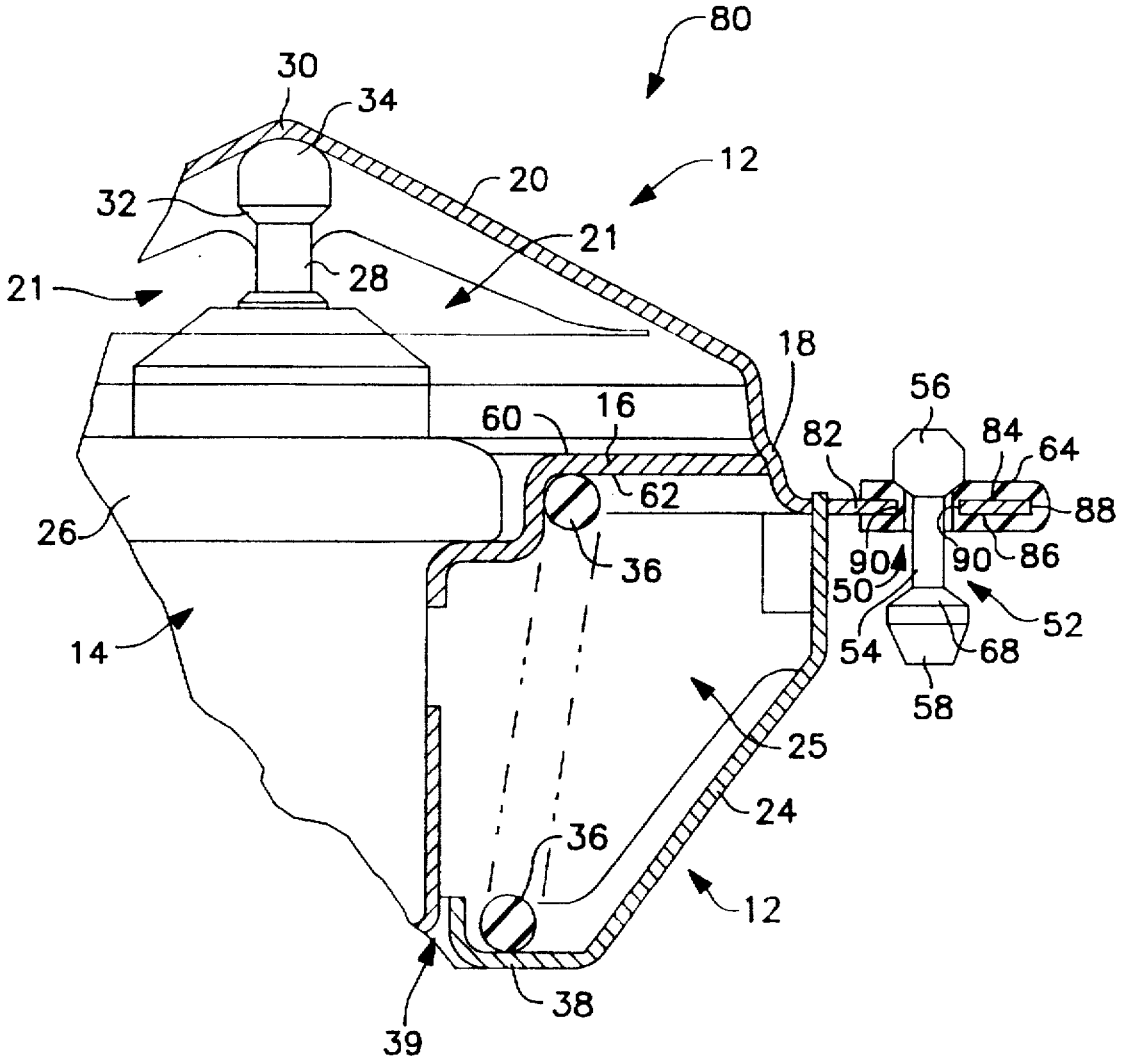
FIG. 4 is a cross-sectional view of an alternative embodiment of the present invention illustrating an annular mounting flange of a stationary valve member formed to include a vent opening, a jiggle pin received in the vent opening, and a wear-resistant, elastomeric material applied to the annular mounting flange to reduce war on the jiggle pin.

Another embodiment of a thermostat 80 in accordance with the present invention is illustrated in FIG. 4. Those numbers referenced by numbers in FIGS. 1–3 perform the same or similar function. Thermostat 80 includes an annular mounting flange 82 which extends radially outwardly from annular valve seat 18 a greater distance than does mounting flange 22 of thermostat 10. Mounting flange 82 of thermostat 80 is formed to include a vent opening 50.

Jiggle pin 52 of thermostat 80 is mounted to mounting flange 82 and is held in vent opening 50 by head and anchor portions 56, 58, as shown in FIG. 4. Anchor portion 58 of jiggle pin 52 is movable to open and close vent opening 50 so that jiggle pin 52 operates as a check valve as discussed above. Elastomeric material 64 is contiguously applied to a top surface 84, a bottom surface 86, and an outer parametrial edge 88 of mounting flange 82. Thus, elastomeric material 64 functions as a gasket when thermostat 80 is installed in the fluid flow system between the inlet and outlet conduits. In addition, elastomeric material 64 is applied to an edge wall 90 which defines the vent opening 50.

Elastomeric material 64 on mounting flange 82 prevents head portion 56 of jiggle pin 52 from contacting top surface 84, prevents anchor portion 58 of jiggle pin 52 from contacting bottom surface 86, and prevents neck portion 54 of jiggle pin 52 from contacting edge wall 90, as shown in FIG. 4. Thus, elastomeric material 64 reduces wear and structural degradation of jiggle pin 52 and annular mounting flange 82 during the service life of thermostat 80. In addition, elastomeric material 64 of thermostat 80 advantageously improves the ability of anchor portion 58 to close vent opening 50 so that fluid leakage through vent opening 50 is minimized or eliminated.

Although the invention has been described in detail with reference to certain preferred embodiments, variations and modifications exist within the scope and spirit of the invention as described and defined in the following claims.

What is claimed is:

1. A thermostat for controlling coolant fluid flow in an engine, the thermostat comprising:

a stationary valve member formed to include an annular valve seat configured to define an opening, a movable valve member coupled to the stationary valve member for movement into and out of engagement with the annular valve seat, the movable valve member being formed to include a vent opening defined by an edge wall, a spring for biasing the valve member to a normally closed position against the annular valve seat of the-stationary valve member, an actuator for selectively moving the movable valve member to an opened position away from the annular valve seat, a jiggle pin having a neck portion located in the vent opening of the movable valve member, a head portion, and an anchor portion, the jiggle pin being movable within the vent open so that the anchor portion opens and closes the vent opening, and an elastomeric material located on the movable valve member covering the edge wall to reduce wear on the jiggle pin.

2. The thermostat of claim 1, wherein the movable valve member includes a top surface and a bottom surface, and the elastomeric material covers at least a portion of the top and bottom surfaces adjacent to the vent opening to reduce wear on the head and anchor portions of the jiggle pin.

3. The thermostat of claim 1, wherein the movable valve member includes an outer edge and the elastomeric material covers outer edge so that the elastomeric material contacts the valve seat when the movable valve member is in the closed position.

4. The thermostat of claim 1, wherein the anchor portion includes a tapered surface for sealing the vent opening.

5. A thermostat for controlling coolant fluid flow in an engine, the thermostat comprising:

a stationary valve member having an annular flange for mounting the thermostat apparatus, the stationary valve member being formed to include an annular valve seat configured to define an opening, the annular flange being formed to include a vent opening defined by an edge wall, a movable valve member coupled to the stationary valve member for movement into and out of engagement with the annular valve seat, a spring to bias the movable valve member to a normally closed position against the annular valve seat of the stationary valve member, an actuator coupled to the movable valve member to move the movable valve member selectively to an opened position spaced apart from the annular valve seat, a jiggle pin located in the vent opening of the stationary valve member, and an elastomeric material located on the stationary valve member and covering the edge wall of the vent opening to reduce wear of the jiggle pin.

6. The thermostat of claim 5, wherein the annular flange includes a top surface and a bottom surface, the jiggle pin includes a neck portion, an anchor portion and a head portion to hold the jiggle pin within the vent opening, the elastomeric material being located on the top and bottom surfaces of the annular flange adjacent to the vent opening to reduce wear of the head and anchor portions of the jiggle pin.

7. The thermostat of claim 6, wherein the anchor portion includes a tapered surface configured to seal the vent opening.

8. The thermostat of claim 6, wherein the annular flange includes an outer edge and the elastomeric material covers the outer edge of the annular flange.

9. A thermostat for controlling coolant fluid flow through a conduit in an engine, the thermostat comprising:

a valve movable from a closed position to an open position to permit fluid flow through the conduit, the valve being formed to include a vent opening defined by a wall, an actuator for selectively opening and closing the valve, an elastomeric material located on the valve covering the wall defining the vent opening, and a jiggle pin located in the vent opening.

10. The apparatus of claim 9, wherein the valve includes a stationary valve member and a movable valve member, the vent opening being formed in the stationary valve member.

11. The apparatus of claim 9, wherein the valve includes a stationary valve member and a movable valve member, the vent opening being formed in the movable valve member.

12. The apparatus of claim 9, wherein the valve includes a top surface and a bottom surface adjacent the vent opening, the jiggle pin includes a head and an anchor to retain the jiggle pin within the vent opening, and the elastomeric material extends over at least a portion of the top and bottom surfaces to engage the head and anchor of the jiggle pin.

* * * * *